US009486114B2

(12) United States Patent
Ball et al.

(10) Patent No.: US 9,486,114 B2
(45) Date of Patent: Nov. 8, 2016

(54) REMOVABLE HEADER FOR A SHOWER DOOR TRACK ASSEMBLY

(71) Applicant: Kohler Co., Kohler, WI (US)

(72) Inventors: Matthew J. Ball, Sheboygan Falls, WI (US); Weerasak Taingtae, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 255 days.

(21) Appl. No.: 14/203,101

(22) Filed: Mar. 10, 2014

(65) Prior Publication Data

US 2014/0259363 A1 Sep. 18, 2014

Related U.S. Application Data

(60) Provisional application No. 61/779,940, filed on Mar. 13, 2013.

(51) Int. Cl.
*A47K 3/00* (2006.01)
*A47K 3/34* (2006.01)

(52) U.S. Cl.
CPC .. *A47K 3/34* (2013.01); *A47K 3/00* (2013.01)

(58) Field of Classification Search
CPC ..... A47K 3/34
USPC ..... 4/596–614
See application file for complete search history.

(56) References Cited

U.S. PATENT DOCUMENTS 2,858,408 A * 10/1958 Barroero ..... F25D 23/021 219/218
2,929,115 A * 3/1960 Beckstrom ..... E05D 15/0626 105/378
3,925,933 A * 12/1975 Reuter ..... E05D 15/0626 16/87 R
4,769,949 A * 9/1988 Glendowne ..... A47K 3/34 16/90
4,811,520 A * 3/1989 Duggan ..... A47K 3/34 49/409
4,998,304 A * 3/1991 Sauter ..... A47K 3/34 4/559

(Continued)

FOREIGN PATENT DOCUMENTS

CN 201167903 Y 12/2008
DE 3446150 A1 * 7/1985

(Continued)

OTHER PUBLICATIONS

European Search Report dated Jun. 26, 2014 for Application No. 14158976.2, 7 pages.

(Continued)

*Primary Examiner* — Lori Baker
(74) *Attorney, Agent, or Firm* — Foley & Lardner LLP

(57) ABSTRACT

A shower door track assembly is disclosed. The shower door track assembly includes a vertical support. The shower door track assembly further includes a lower rail connected to the vertical support configured to receive a roller of a sliding shower door. The shower door track assembly includes a connecting projection connected to the vertical support. The shower door track assembly further includes a removable header including an upper roller retainer. The removable header is removably attachable to the connecting projection such that when the removable header is attached to the connecting projection, the upper roller retainer prevents a received roller from being removed from the lower rail, and when the removable header is detached from the connecting projection, the received roller is removable from the lower rail.

20 Claims, 6 Drawing Sheets

(56) References Cited

U.S. PATENT DOCUMENTS

| | | | | |
|---|---|---|---|---|
| 5,598,666 | A * | 2/1997 | Kurth | A47K 3/34 4/557 |
| 6,381,904 | B1 * | 5/2002 | Tedescucci | A47K 3/34 16/87.4 R |
| 7,653,966 | B2 * | 2/2010 | Quinn | E05D 15/0647 16/87.6 R |
| 7,779,578 | B2 * | 8/2010 | Gray | E06B 3/01 49/409 |
| 7,891,052 | B2 * | 2/2011 | Haab | E05D 15/0634 16/105 |
| 7,900,318 | B2 * | 3/2011 | Hanley | A47K 3/34 16/87.4 R |
| 8,297,334 | B2 * | 10/2012 | Chu | E06B 9/36 160/196.1 |
| 8,850,659 | B2 * | 10/2014 | Ewing | E05D 15/0634 16/105 |
| 2011/0072577 | A1 * | 3/2011 | Luedke | A47K 3/34 4/607 |

FOREIGN PATENT DOCUMENTS

| | | | |
|---|---|---|---|
| EP | 2664262 | A2 | 11/2013 |
| WO | WO 2012/037701 | A1 | 3/2012 |

OTHER PUBLICATIONS

Notification of First Office Action in related Chinese Application No. 201410088352.7 dated Jun. 25, 2015, 8 pages.

* cited by examiner

REMOVABLE HEADER FOR A SHOWER DOOR TRACK ASSEMBLY

CROSS-REFERENCE TO RELATED APPLICATIONS

This application claims the benefit of U.S. Provisional Patent Application No. 61/779,940, entitled "REMOVABLE HEADER FOR A SHOWER DOOR TRACK ASSEMBLY," filed on Mar. 13, 2013, which is hereby incorporated by reference in its entirety and for all purposes.

BACKGROUND

This application relates to sliding shower doors, and more particularly, to a removable header for a shower door assembly.

Shower doors may be slidably attached to a shower door track. The track is often positioned inside the shower (i.e., obscured from a viewer outside the shower) for aesthetic reasons. The top portion of a shower door may include rollers or wheels that glide along the track to allow for easy opening and closing of the shower doors. An installer typically must angle a shower door when installing the door onto the appropriate track and blindly position the rollers or wheels into the track, since the installer does not have a clear line of sight to view the placement of the shower door rollers or wheels into the track.

SUMMARY

One embodiment relates to a shower door track assembly. The shower door track assembly includes a vertical support. The shower door track assembly further includes a lower rail connected to the vertical support configured to receive a roller of a sliding shower door. The shower door track assembly includes a connecting projection connected to the vertical support. The shower door track assembly further includes a removable header including an upper roller retainer. The removable header is removably attachable to the connecting projection such that when the removable header is attached to the connecting projection, the upper roller retainer prevents a received roller from being removed from the lower rail, and when the removable header is detached from the connecting projection, the received roller is removable from the lower rail.

Another embodiment relates to a shower assembly. The shower assembly includes one of a tub and a shower receptor having a top ledge and a lower track assembly connected to the top ledge. The shower assembly further includes an upper track assembly having a vertical support, a first lower rail connected to the vertical support, a first connecting projection connected to the vertical support, and a first removable header including a first upper roller retainer. The shower assembly includes a first sliding shower door having a first roller received in the first lower rail. The first sliding shower door is slidable along a length of the lower track assembly and the upper track assembly. The first removable header is removably attachable to the first connecting projection such that when the first removable header is attached to the first connecting projection, the first upper roller retainer prevents the first roller from being removed from the first lower rail, and when the first removable header is detached from the first connecting projection, the first roller is removable from the first lower rail.

DETAILED DESCRIPTION

Referring to the FIGURES generally, various embodiments disclosed herein relate to a removable header for an upper shower door track assembly. The removable header is positioned to prevent accidental derailment of a sliding shower door from the upper shower door track assembly and at least partially to block a line of sight to the shower door track assembly components. The removable header is removable from the upper track assembly to provide easy access for installation, adjustment, or removal of a sliding shower door.

Figure 1:
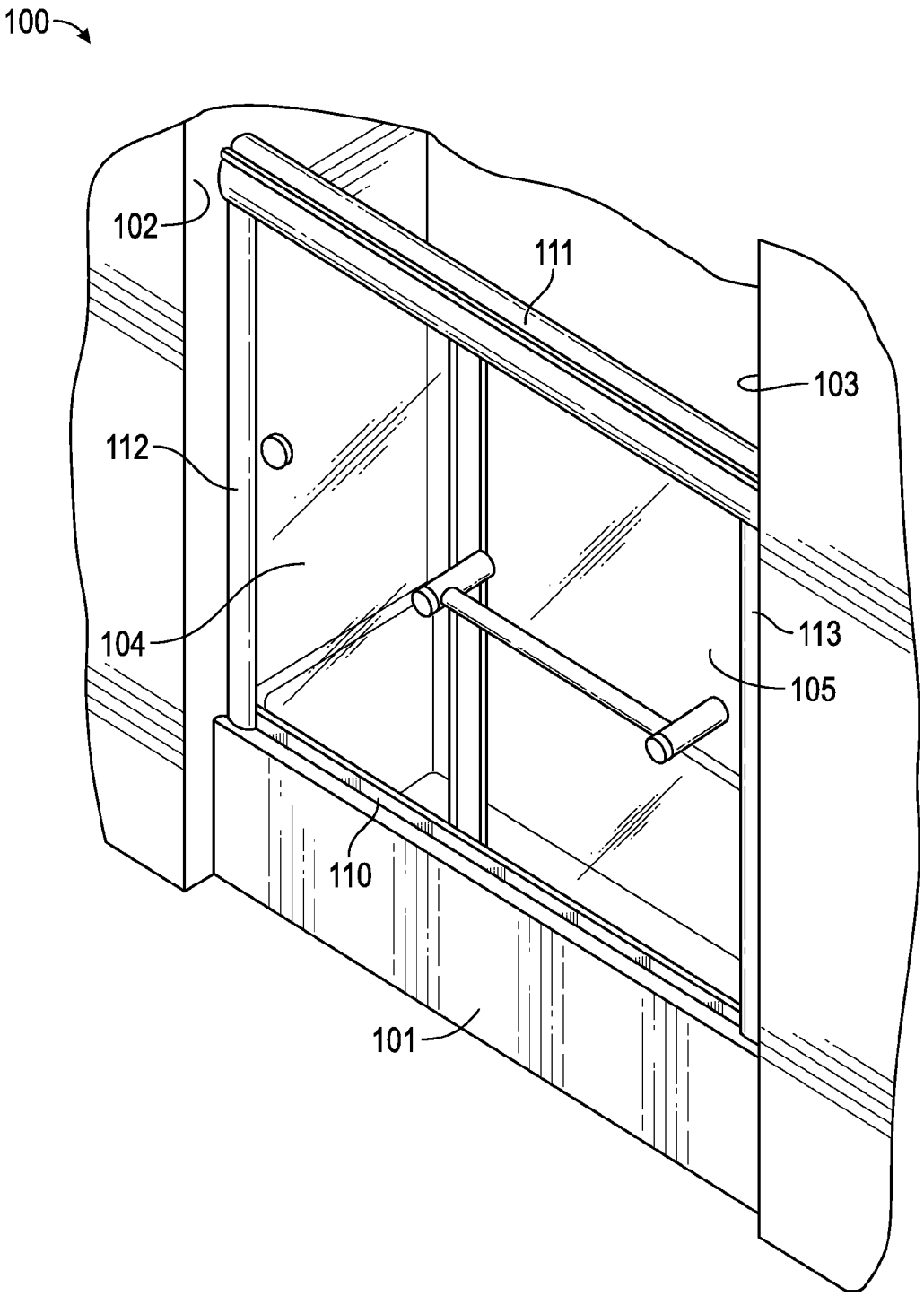
FIG. 1 is a perspective view of a shower having sliding doors according to an exemplary embodiment.

Referring to FIG. 1, shower 100 is shown according to an exemplary embodiment. Shower 100 includes tub 101, which is positioned between first wall 102 and second wall 103. Alternatively, shower includes a shower receptor positioned between first wall 102 and second wall 103. Access to shower 100 is closed off by sliding shower doors 104 and 105. Shower doors 104 and 105 slide along the length of lower track assembly 110 and upper track assembly 111. Lower track assembly 110 may be connected to a top ledge of tub 101 or may be connected to the top ledge of a shower receptor. Upper track assembly 111 may be connected to walls 102 and 103 and/or supported by wall jambs 112 and 113. Sliding motion of shower doors 104 and 105 is limited by wall jambs 112 and 113 and/or by walls 102 and 103. Shower door 104 and shower door 105 can slide in either direction past one another along lower track assembly 110 and upper track 111 to create a passageway adjacent either side wall 102 or 103 through which a bather enters and exits shower 100.

Figure 2:
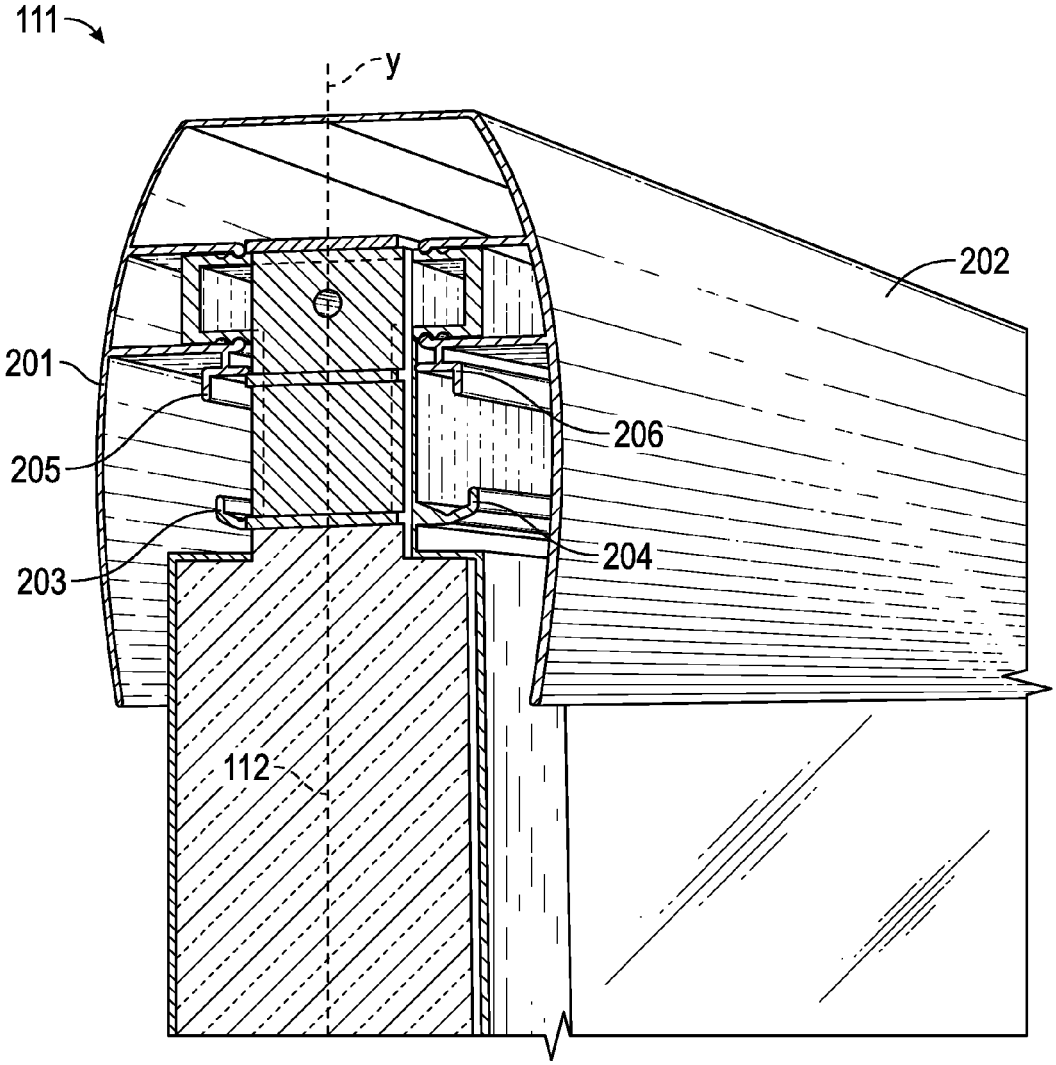
FIG. 2 is a perspective view of an upper track assembly of a shower having sliding doors according to an exemplary embodiment.

With respect to FIG. 2, upper track assembly 111 is shown according to an exemplary embodiment. Upper track assembly 111 is generally symmetrical about vertical axis Y. In an alternative arrangement, upper track assembly 111 is not symmetrical about vertical axis Y. Upper track assembly 111 includes removable members or elements provided in the form of headers 201 and 202. Removable headers 201 and 202 may be removed from upper track assembly 111 and replaced onto upper track assembly 111 without damaging removable headers 201 and 202 and upper track assembly 111. Removable headers 201 and 202 visually cover lower tracks 203 and 204 such that a bather cannot easily see the internal components of upper track assembly 111 because removable headers 201 and 202 at least partially block a line of sight to lower tracks 203 and 204. Lower tracks 203 and 204 are configured to receive rollers or wheels of shower doors 104 and 105. Lower tracks 203 and 204 are positioned on opposite sides of track assembly 111. Further, removable headers 201 and 202 each include an upper roller retainer (205 and 206 respectively). Upper roller retainers 205 and 206 prevent accidental derailment of shower doors 104 and 105 during sliding or during application of a load to shower doors 104 and 105 that has a component perpendicular to the plane defined by shower doors 104 and 105.

Upper track assembly 111 is shown according to the exemplary embodiment shown in FIG. 2 through FIG. 5. However, upper track assembly 111 may differ in alternative embodiments from the manner drawn in FIG. 2 through FIG. 5 without departing from the scope of the disclosed embodiments. For example, the size and shape of removable headers 201 and 202 may be different than those disclosed in FIG. 2 through FIG. 5. Further, the manner in which removable headers 201 and 202 removably attach to upper track assembly 111 to an intermediate member(s) or to each other may differ than the manner disclosed in FIG. 2 through FIG. 5. Additionally, the shape, position, and orientation of lower tracks 203 and 204 may be altered to accept differently sized and shaped shower doors and shower door rollers without departing from the scope of the disclosed embodiments.

Figure 3:
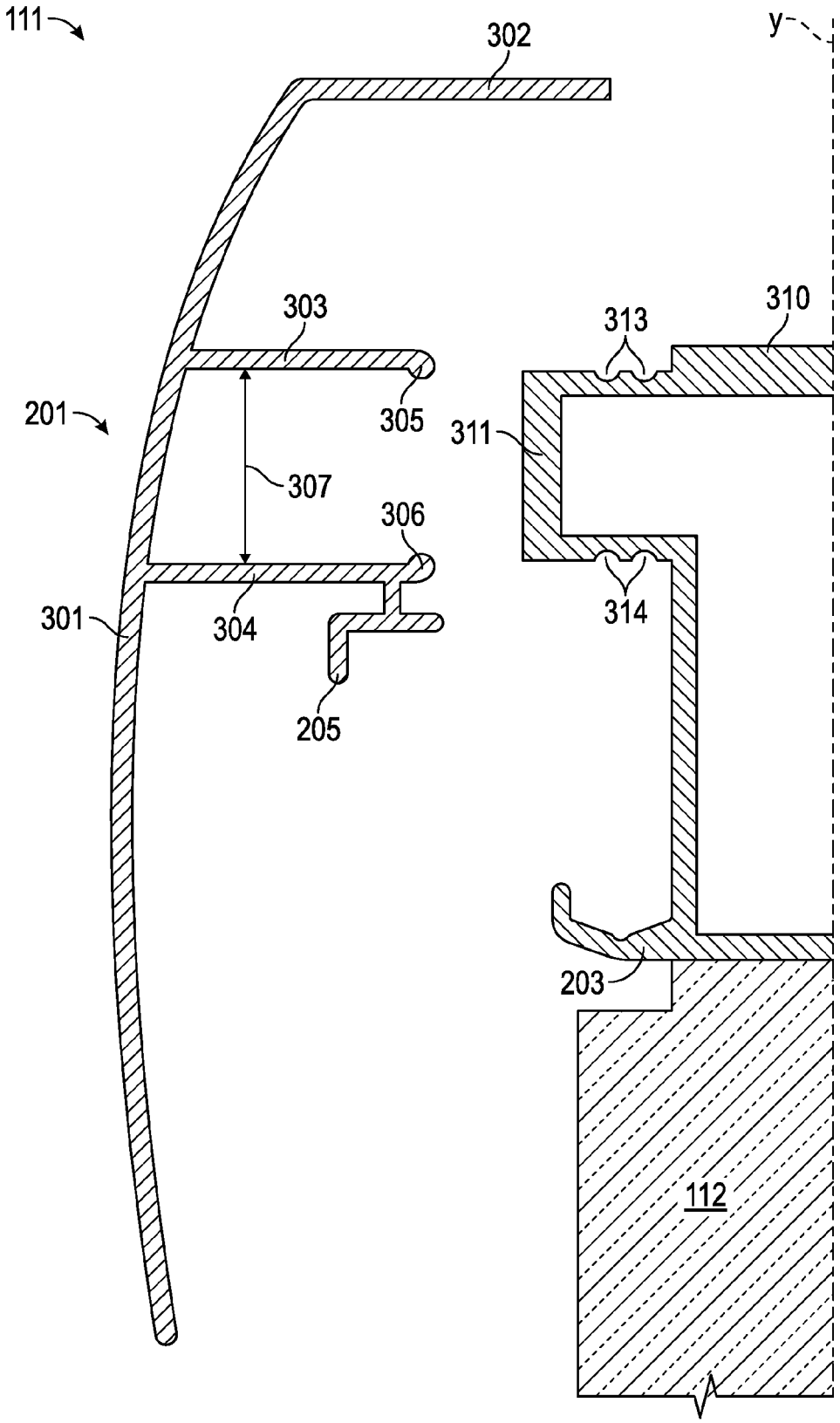
FIG. 3 is an exploded side view of a portion of an upper track assembly having a removable header in a removed position according to an exemplary embodiment.

Referring to FIG. 3, a side view of upper track assembly 111 with removable header 201 removed is shown according to an exemplary embodiment. Removable header 201 includes curved fascia 301 and top side 302. When removable header 201 is attached to upper track assembly 111, curved fascia 301 covers upper track assembly 111 components and provides an aesthetically pleasing view of upper track assembly 111 by at least partially blocking a line of sight to lower track 203. Removable header 201 includes upper arm 303 and lower arm 304. Both upper arm 303 and lower arm 304 are connected to curved fascia 301. Upper arm 303 includes upper holding projection 305, and lower arm 304 includes lower holding projection 306. Lower arm 304 includes upper roller retainer 205 opposite lower holding projection 306. Upper roller retainer 205 is generally "L" shaped having a horizontal portion that is generally parallel to lower arm 304 and a vertical portion that is generally perpendicular to lower arm 304. Upper arm 303 and lower arm 304 are generally parallel and spaced apart by distance 307. Removable header 202 has the same arrangement as removable header 201, but is mirrored along axis Y (as shown in FIG. 2).

Still referring to FIG. 3, upper track assembly 111 includes vertical wall support 310. Vertical wall support 310 may be hollow. Vertical wall support 310 may be affixed to a cleat mounted to walls 102 and 103 or may be affixed atop wall jamb(s) 112 and/or 113. Vertical wall support 310 is symmetric about axis Y. Vertical wall support 310 includes lower track 203 and header connecting projection 311. Lower track 203 is generally "L" shaped and forms a "C," "V," or "U" shaped channel with vertical wall support 310 to receive a shower door roller (e.g., roller 403 as described in FIG. 4 and FIG. 5). Header connecting projection 311 includes upper detents 313 and lower detents 314. Upper detents 313 are sized and shaped to receive upper holding projection 305, and lower detents 314 are sized and shaped to receive lower holding projection 306. Header connecting projection 311 has a vertical width along the direction of axis Y that is slightly smaller than distance 307, such that upper arm and lower arm fit over header connecting projection 311 and provide a frictional hold of removable header 201 to upper track assembly 111. Header connecting projection 311 is drawn as including two of each of upper and lower detents 313 and 314. However, any geometry, type, and number of upper and lower detents 313 and 314 may be used (e.g., 1 pair of detents, 2 pairs of detents, 3 pairs of detents, etc.). In some arrangements, upper and lower arms 303 and 304 may include multiple holding projections 305, 306 to fit in a corresponding number of upper and lower detents. Further, detents 313 and 314 do not need to be located on the upper and lower surfaces of connecting projection 311 (e.g., detents 313 and 314 may be arranged on another surface such as a side surface or the surface of an additional projecting portion). Upper and lower detents 313 and 314 are configured to retain removable header 201 and to provide tactile feedback to an installer during removal or attachment of removable header 201 over header connecting projection 311 (e.g., an installer can feel "clicks," or lack there of, as he is attaching or removing removable header 201 to or from upper track assembly 111). In an alternate arrangement, removable header 301 connects to upper track assembly 111 via mating slots and projections, an interference fit, or any other suitable connection.

Figure 4:
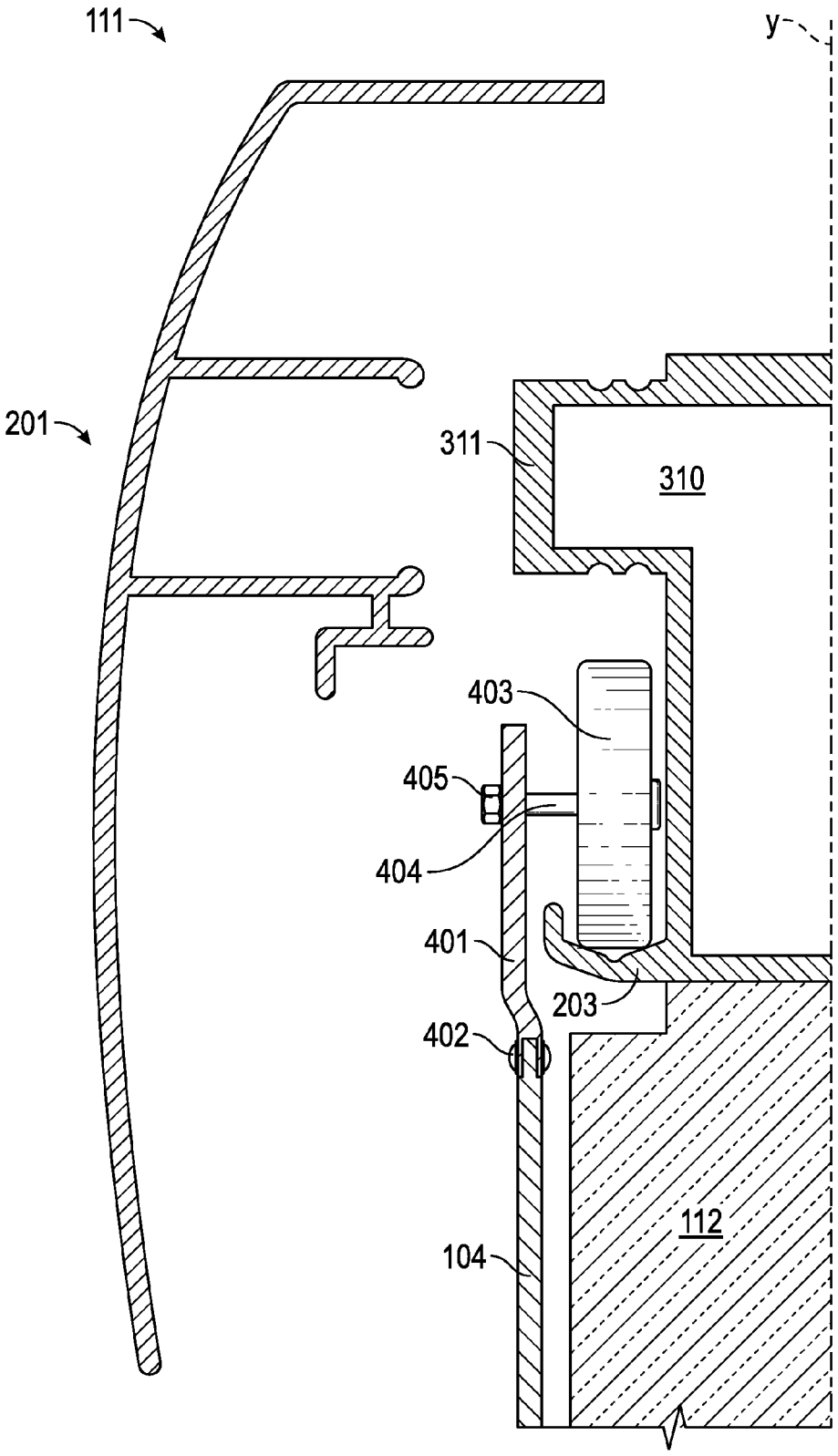
FIG. 4 is an exploded side view of a portion of an upper track assembly having a removable header in a removed position and a shower door installed on the upper track assembly according to an exemplary embodiment.

Referring to FIG. 4, a side view of upper track assembly 111 with removable header 201 removed and door 104 installed is shown according to an exemplary embodiment. Door 104 includes mounting bracket top frame 401. Mounting bracket top frame 401 is attached to door 104 by fastener 402. Fastener 402 may be a rivet, mating threaded pieces (i.e., mating male and female threaded pieces on each side of door 104 going through or into mounting bracket top frame 401), a thread cutting screw and a hole in a material into which the screw is fastened, a bolt and nut, a cam dowel and cam lock assembly, or another suitable mechanical connection. Alternatively, mounting bracket top frame 401 may be secured to door 104 with an adhesive, a snap-fit connection, or via a friction hold. Mounting bracket top frame 401 includes roller 403. Roller 403 is sized and shaped to be received in lower track 203. Door 104 includes at least two rollers 403 spaced out across the top length of 104 (e.g., one at each end of door 104) such that each roller 403 is received in lower track 203 and door 104 can slide along the length of upper track assembly 111. Roller 403 is attached to mounting bracket top frame 401 such that roller 403 can rotate about its center to provide smooth sliding of door 104 during opening and closing. Roller 403 is secured to mounting bracket top frame with fastener 405. Fastener 405 may act as an axle for roller 403. Fastener 405 may be a rivet, a screw (i.e., mating male and female threaded pieces on each side of roller 403 going through mounting bracket top frame 401), or another suitable mechanical connection. A spacer (not shown) may be integrally manufactured into roller 403 to maintain roller spacing along axle 404 from mounting bracket top frame 401.

Figure 5:
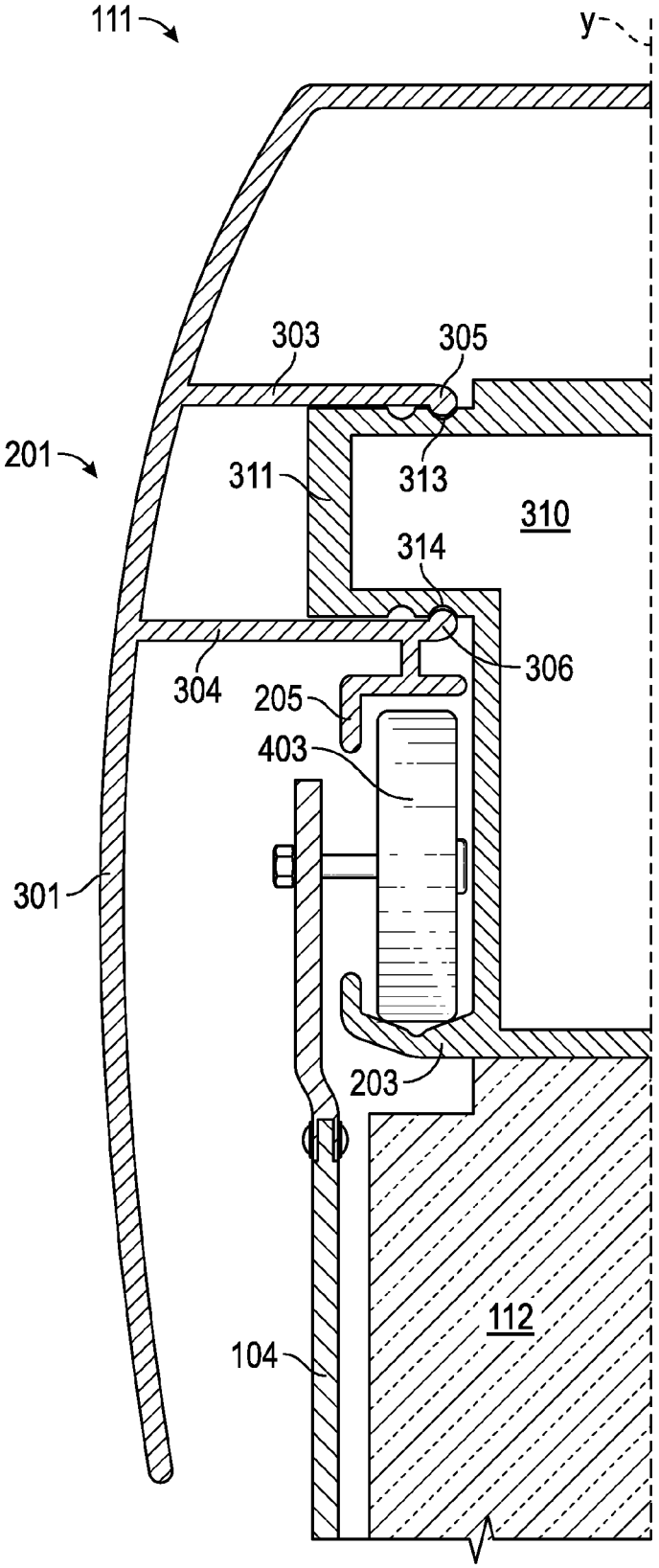
FIG. 5 is a side view of a portion of an upper track assembly having a removable header in an attached position and a shower door installed on the upper track assembly according to an exemplary embodiment.

Referring to FIG. 5, a side view of upper track assembly 111 with removable header 201 attached and door 104 installed is shown according to an exemplary embodiment. To attach removable header 201 to upper track assembly 111, removable header 201 is placed such that upper arm 303 and lower arm 304 slide over header connecting projection 311. When upper arm 303 and lower arm 304 slide over header connecting projection 311 into the attached position (as shown in FIG. 5), upper holding projection 305 is received in upper detent 313, and lower holding projection 306 is received in lower detent 314. Upper arm 303 and lower arm 304 act as spring arms and snap upper holding projection 305 and lower holding projection 306 into upper and lower detents 313 and 314. Removable header 201 forms a snap-fit connection with upper track assembly 111. Accordingly, removal of removable header 201 requires a pulling force away from upper track assembly 111 great enough to deflect upper arm 303 and lower arm 304 such that upper holding projection 305 and lower holding projection 306 slide out of upper and lower detents 313 and 314. When removable header 201 is connected to upper track assembly 111 and door 104 is positioned such that roller 403 is received in lower track 203, upper roller retainer 205 is positioned such that roller 403 cannot be removed from lower track 203 without removal of removable header 201. Upper roller retainer 205 prevents accidental removal or derailment of door 104.

In addition to preventing accidental derailments of door 104 from upper track assembly 111, removable header 201 provides for visible installation and removal of door 104 from upper track assembly 111. To remove or install door 104 from or to upper track assembly 111, the installer first removes removable header 201 from upper track assembly 111 by applying outward force perpendicular to axis Y. The outward force must be great enough to deflect upper arm 303 and lower arm 304 such that upper holding projection 305 and lower holding projection 306 slide out of upper and lower detents 313 and 314. When the proper force is applied, removable header 201 will slide away from upper track assembly 111 and can be completely removed when upper arm 303 and lower arm 304 clear header connecting projection 311. Upon removal of removable header 201, upper track assembly 111, including the location of lower track 203 is visible to the installer. Accordingly, the installer can place door 104 such that roller 403 is received in lower track 203 or remove door 104 by removing roller 403 from lower track 203 without having to angle door 104 with respect to axis Y. Once door 104 is placed into upper track assembly 111, adjustment to the roller 403 can be made while shower doors 104 and 105 are in the installed position in shower 100. Removable header 201 may then be repositioned back onto upper track assembly 111 by sliding upper arm 303 and lower arm 304 over header connecting projection 311 until upper holding projection 305 and lower holding projection 306 are received in upper and lower detents 313 and 314.

As drawn in the figures, removable headers 201 and 202 have generally rounded shapes. Any decorative shape may be applied to removable headers 201 and 202. For example, curved fascia 301 may be shaped to be rectangular or to have the appearance of crown molding. Additionally, FIG. 3 through FIG. 5 have been drawn as showing only one side of upper track assembly 111. It should be understood that upper track assembly 111 may be mirrored about axis Y to include two removable headers and two lower tracks in order to support two shower doors (as shown in FIG. 2).

Figure 7:
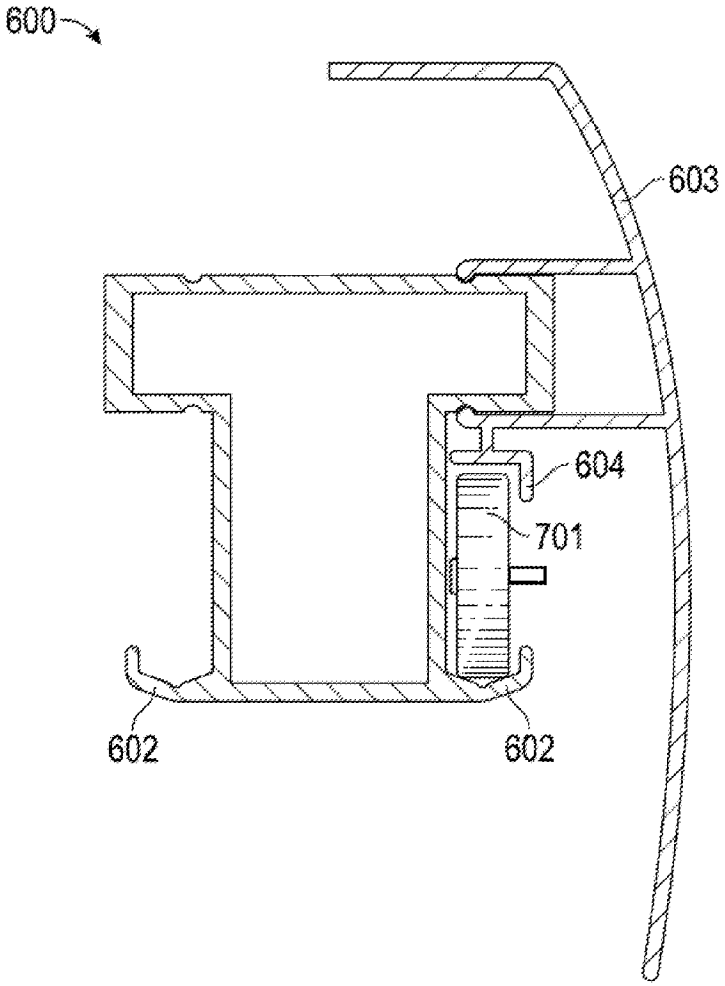
FIG. 7 is a side view of a portion of an upper track assembly having a removable header in an attached position and a shower door roller on the upper track assembly according to an exemplary embodiment.
Figure 6:
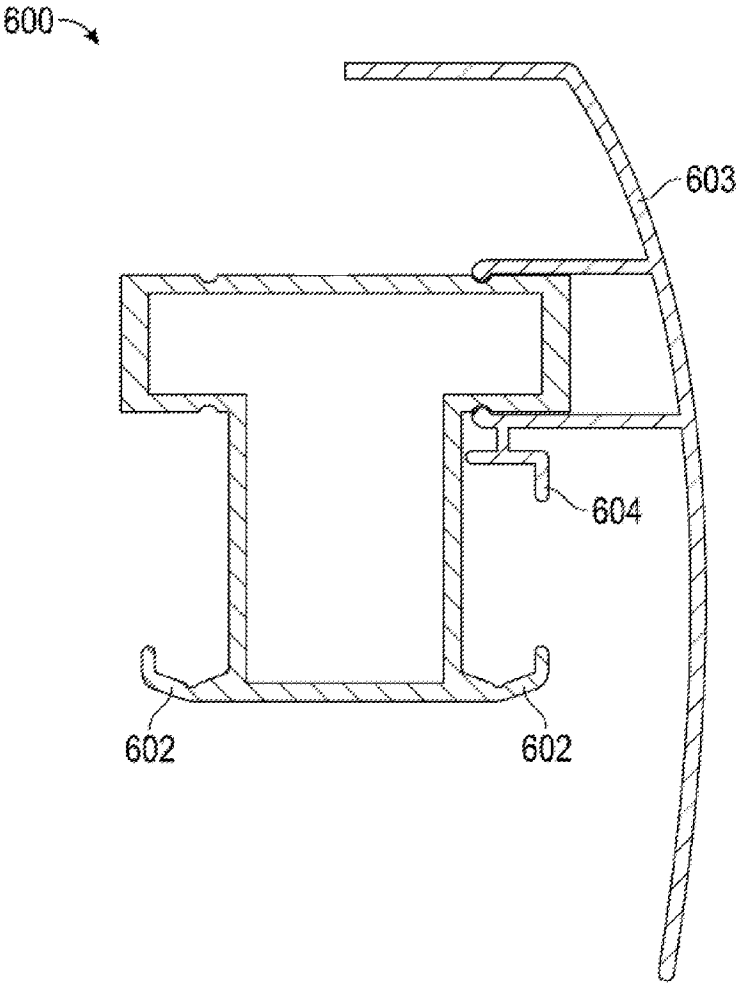
FIG. 6 is a side view of a portion of an upper track assembly having a removable header in an attached position according to an exemplary embodiment.

With respect to FIG. 6 a side view of a portion of an upper track assembly 600 having a removable header 603 in an attached position is shown according to an exemplary embodiment. Upper track assembly includes lower tracks 602. Removable header 603 includes upper roller retainer 604. A second removable header may be placed opposite removable header 603. With respect to FIG. 7, a side view of a portion of upper track assembly 600 having a removable header 603 in an attached position and a shower door roller 701 on upper track assembly 600 is shown according an exemplary embodiment. Roller 701 is the roller of a sliding shower door (not shown). Roller 701 may be installed, adjusted, and removed in the same manner as discussed above with respect to upper track assembly 111.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shower door track assembly, comprising:

a vertical support;

a lower rail connected to the vertical support configured to receive a roller of a sliding shower door;

a connecting projection connected to the vertical support; and a removable header including an upper roller retainer, a first arm, and a second arm, wherein the first arm and the second arm are generally parallel and spaced apart;

wherein the removable header is removably attachable to the connecting projection such that when the removable header is attached to the connecting projection, the upper roller retainer prevents a received roller from being removed from the lower rail, and when the removable header is detached from the connecting projection, the received roller is removable from the lower rail.

2. The shower door track assembly of claim 1, further comprising:

a first detent on a first side of the connecting projection; and a first holding projection on the first arm;

wherein the first holding projection is received in the first detent when the removable header is attached to the connecting projection.

3. The shower door track assembly of claim 2, further comprising:

a second detent on a second side of the connecting projection; and a second holding projection on the second arm;

wherein the second holding projection is received in the second detent when the removable header is attached to the connecting projection.

4. The shower door track assembly of claim 1, wherein the first arm and the second arm are spring arms.

5. The shower door track assembly of claim 1, wherein the upper roller retainer is generally "L" shaped.

6. The shower door track assembly of claim 1, wherein the removable header includes a fascia configured to at least partially block a line of sight to the lower rail.

7. The shower door track assembly of claim 6, wherein the fascia is curved.

8. The shower door track assembly of claim 1, wherein the lower rail and the vertical support form a generally "C," "V," or "U" shaped channel.

9. A shower assembly, comprising:

one of a tub and a shower receptor having a top ledge;

a lower track assembly connected to the top ledge;

an upper track assembly including a vertical support, a first lower rail connected to the vertical support, a first connecting projection connected to the vertical support, a first removable header including a first upper roller retainer, a first arm, and a second arm, wherein the first arm and the second arm are generally parallel and spaced apart; and a first sliding shower door having a first roller received in the first lower rail;

wherein the first sliding shower door is slidable along a length of the lower track assembly and the upper track assembly;

wherein the first removable header is removably attachable to the first connecting projection such that when the first removable header is attached to the first connecting projection, the first upper roller retainer prevents the first roller from being removed from the first lower rail, and when the first removable header is detached from the first connecting projection, the first roller can be removed from the first lower rail.

10. The shower assembly of claim 9, wherein the first removable header includes a fascia configured to at least partially block a line of sight to the first lower rail.

11. The shower assembly of claim 9, wherein the upper track assembly further comprises a second lower rail connected to the vertical support, a second connecting projection connected to the vertical support, and a second removable header including a second upper roller retainer.

12. The shower assembly of claim 11, further comprising:

a second sliding shower door having a second roller received in the second lower rail;

wherein the second sliding shower door is slidable along the length of the lower track assembly and the upper track assembly; and wherein the second removable header is removably attachable to the second connecting projection such that when the second removable header is attached to the second connecting projection, the second upper roller retainer prevents the second roller from being removed from the second lower rail, and when the second removable header is detached from the second connecting projection, the second roller can be removed from the second lower rail.

13. The shower assembly of claim 11, wherein the first lower rail and the second lower rail are located on opposite sides of the vertical support.

14. The shower assembly of claim 9, further comprising:

a first detent on a first side of the first connecting projection; and a first holding projection on the first arm;

wherein the first holding projection is received in the first detent when the first removable header is attached to the first connecting projection.

15. The shower assembly of claim 14, further comprising:

a second detent on a second side of the first connecting projection; and a second holding projection on the second arm;

wherein the second holding projection is received in the second detent when the first removable header is attached to the first connecting projection.

16. The shower assembly of claim 9, wherein the first arm and the second arm are spring arms.

17. The shower assembly of claim 9, wherein the first upper roller retainer is generally "L" shaped.

18. The shower assembly of claim 9, wherein the first lower rail and the vertical support form a generally "C," "V," or "U" shaped channel.

19. The shower door track assembly of claim 1, wherein the first arm and the second arm are spaced apart by a separation distance that is larger than a width of the connecting portion such that the connecting projection is received between the first arm and the second arm when the removable header is attached to the connecting projection.

20. The shower assembly of claim 9, wherein the first arm and the second arm are spaced apart by a separation distance that is larger than a width of the first connecting portion such that the first connecting projection is received between the first arm and the second arm when the first removable header is attached to the first connecting projection.

* * * * *